United States Patent [19]

Guth

[11] 3,934,728

[45] Dec. 27, 1976

[54] DISHWASHER RACK

[75] Inventor: Lauren W. Guth, Louisville, Ky.

[73] Assignee: General Electric Company, Louisville, Ky.

[22] Filed: Oct. 15, 1974

[21] Appl. No.: 514,377

[52] U.S. Cl. ..... 211/128; 211/181; 220/19

[51] Int. Cl.[2] ..... A47F 5/13

[58] Field of Search ..... 211/128, 126, 71, 74, 84, 211/181; 220/19; 206/513

[56] References Cited

UNITED STATES PATENTS

| | | | |
|---|---|---|---|
| 1,493,948 | 5/1924 | Apple | 220/19 |
| 1,691,858 | 11/1928 | Ryerson | 220/19 |
| 2,793,761 | 5/1957 | Geralds | 211/126 X |
| 3,419,175 | 12/1968 | Laughlin et al. | 220/19 |

FOREIGN PATENTS OR APPLICATIONS

| | | | |
|---|---|---|---|
| 983,593 | 2/1951 | France | 220/19 |

*Primary Examiner*—Ramon S. Britts

[57] ABSTRACT

An improved dishwasher rack in which a small items secondary rack is pivotally connected to a base rack and movable between a vertical storage position substantially perpendicular to the base rack and a horizontal position overlaying the first rack, thus providing an extra rack for drying of small items both in the base rack and on the secondary rack.

4 Claims, 2 Drawing Figures

DISHWASHER RACK

BACKGROUND OF THE INVENTION

In the use of a household automatic dishwasher, it is desirable to alter the configuration of the dish rack to more efficiently accommodate varying types of loads. Where there are many short, relatively small items, a greater number of the items could be effectively positioned in the dishwasher if a plurality of racks were available in the dishwasher. The next load desired to be cleaned might, however, comprise a plurality of tall items which could not be placed generally upright between the abovementioned plurality of racks owing to the space limitations between the plurality of racks.

Dishwashers have been constructed having a plurality of base racks that are separable from the dishwasher and movable to various elevations in the dishwasher for solving the above-described problems. An example of such a dishwasher is found in U.S. Pat. No. 2,635,760-Nicholas.

However, this approach to solving the problem utilized additional rack-holding elements. Further, some racks when not in use were sometimes required to be removed from the dishwasher to accommodate tall items. This removed dish rack then generated a storage problem, and racks when stored were sometimes damaged.

In accordance with the apparatus of this invention, the above-described disadvantages are alleviated with the advantage of having a unitary assembly that generally remains within the dishwasher.

SUMMARY OF THE INVENTION

In accordance with this invention, an automatic dishwasher has a base rack having a plane, a first side portion, and upstanding spaced-apart rack fingers. A secondary rack has a first side portion and is pivotally connected to the first side portion of the base rack. The secondary rack is pivotally movable between a first position at which the second rack extends substantially perpendicularly to the plane of the base rack and a second position at which the secondary rack overlays the plane of the base rack. Holding means on the secondary rack are associated with the base rack fingers for maintaining the secondary rack with and supporting said secondary rack by said fingers.

DETAILED DESCRIPTION OF THE INVENTION

Figure 1:
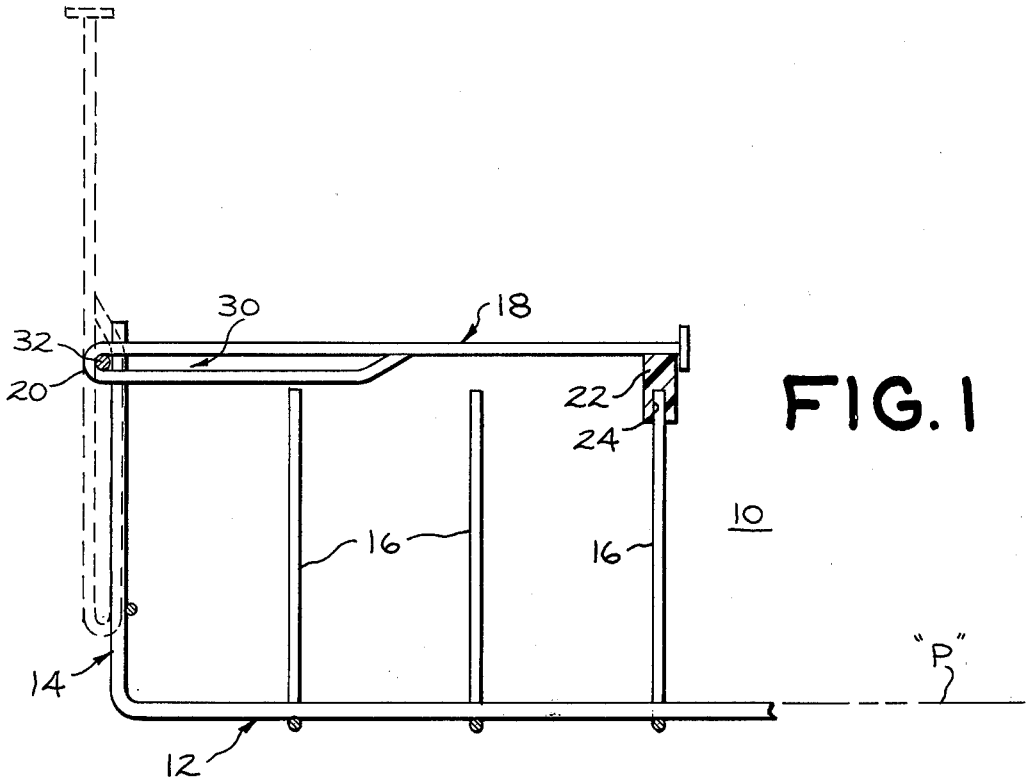
FIG. 1 is a diagrammatic side view of the dishwasher rack of this invention.
Figure 2:
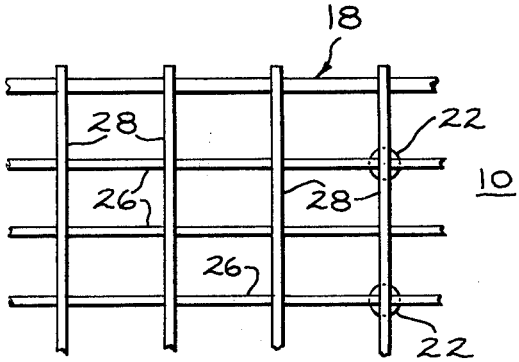
FIG. 2 is a partial, top view of the secondary rack of FIG. 1.

In the embodiment of FIGS. 1 and 2, an automatic dishwasher 10 has a base rack 12, as is known in the art. The base rack is generally rectangular, has a first side portion 14, and upstanding fingers for holding items to be cleaned.

A secondary rack 18 has a first side portion 20 pivotally connected to the first side portion 14 of the base rack 12.

Referring to FIG. 1, the secondary rack 18 is pivotally movable between a first position, shown by broken lines, at which the secondary rack extends substantially perpendicularly to the plane P of the base rack 12 and a second position, shown by solid lines, at which the secondary rack 18 overlays the plane P of the base rack 12.

The secondary rack 18 is releasably connected to and supported by the base rack fingers 16. The secondary rack 18 has holding elements 22 extending downwardly therefrom and into contact with the fingers 16. The holding elements 22 have a concave portion 24 of dimensions sufficient for frictionally receiving one of the fingers 16 therein at the second position of the secondary rack 18. These holding elements 22 are preferably formed of rubber or plastic.

Referring to FIG. 2, the secondary rack 18 is formed of a plurality of longitudinally, transversely extending spaced-apart support elements 26, 28 forming an open grid work.

Referring to FIG. 1, the secondary rack 18 can have a slot 30 extending outwardly from the first side portion 20 and slidably receiving a retaining element 32 of the base rack 12 defining a slideable pivot arrangement for providing slidable movement of the secondary rack 18 between the second position, wherein substantially the entire secondary rack is at a higher elevation than the base rack 12 and the stored position, as shown by broken lines, at which a major portion of the secondary rack 18 is at an elevation lower than said first elevation. The retaining element 32 can be a portion of the secondary rack 18 and be provided with fastening means for releasably connecting it to the base rack 12.

In the stored position of the secondary rack 18, tall items can be placed on the base rack for washing. When it is desired to wash a number of small items greater than the number of items accommodated by the base rack, the secondary rack can be moved from the stored or the first position to the second position after the base rack has been filled with items to be washed. The secondary rack at the second position can then be filled with items to be washed.

After washing is completed, the secondary rack 18 can be moved to the second or stored position.

Other modifications and alterations of this invention will become apparent to those skilled in the art from the foregoing discussion, and it should be understood that this invention is not to be unduly limited thereto.

What is claimed is:

1. In a rack assembly for an automatic dishwasher having a base rack lying in a generally horizontal plane, a first side portion, and upstanding spaced-apart rack fingers, the improvement comprising:

a secondary rack having a first side portion connected by a slidable pivot arrangement to the first side portion of the base rack and being pivotally and slidably movable between a first position at which the secondary rack extends substantially perpendicularly to the plane of the base rack and a second position at which the secondary rack overlies the horizontal plane of the base rack in parallel alignment therewith; and holding elements for securing the secondary rack to said fingers and supporting said secondary rack in said horizontal position overlying said base rack.

2. Apparatus, as set forth in claim 1, wherein the secondary rack comprises a plurality of longitudinally and transversely extending spaced-apart support elements forming an open gridwork.

3. Apparatus, as set forth in claim 1, wherein said slidable pivot arrangement of said secondary rack includes a slot extending outwardly from the first side and slidably receiving a retaining element of the base rack for providing slidable movement of the secondary rack between the second position, wherein substantially the entire secondary rack is at a first higher elevation than the base rack, and a stored position at which a major portion of the secondary rack is at an elevation lower than said first elevation.

4. Apparatus, as set forth in claim 1, wherein said holding elements each have a concave portion of dimensions sufficient for frictionally receiving one of the fingers therein thereby securing said rack in its second position.

* * * * *

UNITED STATES PATENT OFFICE

CERTIFICATE OF CORRECTION

Patent No. 3,934,728 Dated December 27, 1976

Inventor(s) Lauren W. Guth

It is certified that error appears in the above-identified patent and that said Letters Patent are hereby corrected as shown below:

On title page, issue date should be changed from

December 27, 1976 to --January 27, 1976--

Signed and Sealed this

*fourth* Day of *May 1976*

[SEAL]

*Attest:*

RUTH C. MASON
*Attesting Officer*

C. MARSHALL DANN
*Commissioner of Patents and Trademarks*